US010653231B2

(12) United States Patent
Gordon

(10) Patent No.: US 10,653,231 B2
(45) Date of Patent: May 19, 2020

(54) RETENTION ACCESSORY

(71) Applicant: Cute & Cocky LLC, Carrollton, GA (US)

(72) Inventor: Nikkita Gordon, Carrollton, GA (US)

( * ) Notice: Subject to any disclaimer, the term of this patent is extended or adjusted under 35 U.S.C. 154(b) by 0 days.

(21) Appl. No.: 16/041,099

(22) Filed: Jul. 20, 2018

(65) Prior Publication Data

US 2019/0021476 A1 Jan. 24, 2019

Related U.S. Application Data

(60) Provisional application No. 62/604,836, filed on Jul. 24, 2017.

(51) Int. Cl.

| | |
|---|---|
| ***A45F 5/02*** | (2006.01) |
| ***F41C 33/04*** | (2006.01) |
| *A41D 1/04* | (2006.01) |

(52) U.S. Cl.

CPC ..... *A45F 5/02* (2013.01); *F41C 33/041* (2013.01); *F41C 33/048* (2013.01); *A41D 1/04* (2013.01); *A41D 2200/20* (2013.01); *A41D 2400/48* (2013.01); *A45F 2200/0591* (2013.01)

(58) Field of Classification Search

CPC .... F41C 33/041; F41C 33/043; F41C 33/048; F41C 33/0236; F41C 33/0245; F41C 33/046; F41C 33/02; A45F 2200/0591

USPC ..... 224/192–193, 198, 238, 243, 911, 651, 224/250, 568, 455, 460, 534

See application file for complete search history.

(56) References Cited

U.S. PATENT DOCUMENTS

| | | | | | |
|---|---|---|---|---|---|
| 4,966,320 | A * | 10/1990 | DeSantis | A45C 1/04 | 224/192 |
| 5,294,031 | A * | 3/1994 | Volpei | A45F 3/00 | 224/192 |
| 5,692,237 | A * | 12/1997 | Bennett | A41D 13/0012 | 2/250 |
| 5,941,434 | A * | 8/1999 | Green | A45F 5/02 | 224/195 |
| 2003/0205595 | A1* | 11/2003 | Young | A45F 5/02 | 224/230 |
| 2004/0182896 | A1* | 9/2004 | Ballard | A45F 3/14 | 224/222 |
| 2015/0144673 | A1* | 5/2015 | Dahl | F41C 33/00 | 224/587 |

* cited by examiner

*Primary Examiner* — Scott T McNurlen
(74) *Attorney, Agent, or Firm* — Duane Morris LLP

(57) ABSTRACT

A retention device includes a body having a first surface and a second surface and defined by a perimeter wall. The second surface is configured to be coupled to an article of clothing. A first retention element is releasably coupled to the body and is configured to be coupled to a weapon system to maintain the weapon system in a fixed position with respect to the body.

14 Claims, 16 Drawing Sheets

RETENTION ACCESSORY

CROSS-REFERENCE TO RELATED APPLICATION

This application claims the benefit of U.S. Provisional Application No. 62/604,836, entitled "RETENTION ACCESSORY FOR HOLSTERS AND FIREARMS," filed Jul. 24, 2017, which is incorporated herein by reference in its entirety.

FIELD

This disclosure relates generally to retention systems for concealing firearms or other weapons, and more specifically, to retention systems for concealing firearms, firearms holsters, or other carrying systems.

BACKGROUND

It is becoming increasingly common for U.S. citizens to own, openly carry and concealed carry firearms for personal protection. Many individuals rely on handguns and nonlethal self-defense products holstered on their body or in an apparatus to provide personal protection for themselves and others. Several states have updated laws to permit conceal carry in an increased number of public places and have issued an increased number of new permits. For example, women and members of the LGBTQ community, who have historically been highly targeted for hate crimes, are increasingly carrying firearms for personal protection.

In order to be effective, a concealed carry system must provide the ability to effectively and conveniently conceal the firearm and the ability to rapidly access the concealed firearm in response to a threat. Current systems exist for concealment and access of firearms for both on-body (i.e., on a person's body) and off-body (i.e., in a bag or other container) carry, including off-body containers (such as backpacks, briefcases, fanny packs, etc.), pass-through compartments within clothing to access outside-the-waist-band (OWB) holster, belly bands, and inside-the-waist-band (IWB) holsters. Each of the existing solutions create complications and require varying systems for different weapons and different scenarios to be used, requiring additional training and thought to be effective in life-threatening situations.

SUMMARY

In various embodiments, a retention device is disclosed. The retention device includes a body having a first surface and a second surface and is defined by a perimeter wall. The second surface is configured to be coupled to an article of clothing. A first retention element is releasably coupled to the body and is configured to be coupled to a weapon system to maintain the weapon system in a fixed position with respect to the body.

In various embodiments, a system including an article of clothing having a retention device coupled thereto is disclosed. The retention system includes a body having a first surface and a second surface and is defined by a perimeter wall. The second surface is configured to be coupled to an article of clothing. A first retention element is releasably coupled to the body and is configured to be coupled to a weapon system to maintain the weapon system in a fixed position with respect to the body.

In various embodiments, a method is disclosed. The method includes a step of transitioning a concealment feature of an article of clothing from a first position to a second position to expose a retention system coupled to the article of clothing. A weapon system is coupled to the retention system. The retention system includes a body including a first surface and a second surface and is defined by a perimeter wall. A first retention element is releasably coupled to the body and the second surface is coupled to the article of clothing. The first retention element is configured to be coupled to the weapon system to maintain the weapon system in a fixed position with respect to the body. The concealment feature is transitioned from the second position to the first position to conceal the retention system and the weapons system.

BRIEF DESCRIPTION OF THE DRAWINGS

The features and advantages of the present invention will be more fully disclosed in, or rendered obvious by the following detailed description of the preferred embodiments, which are to be considered together with the accompanying drawings wherein like numbers refer to like parts and further wherein.

DETAILED DESCRIPTION

Figure 1:
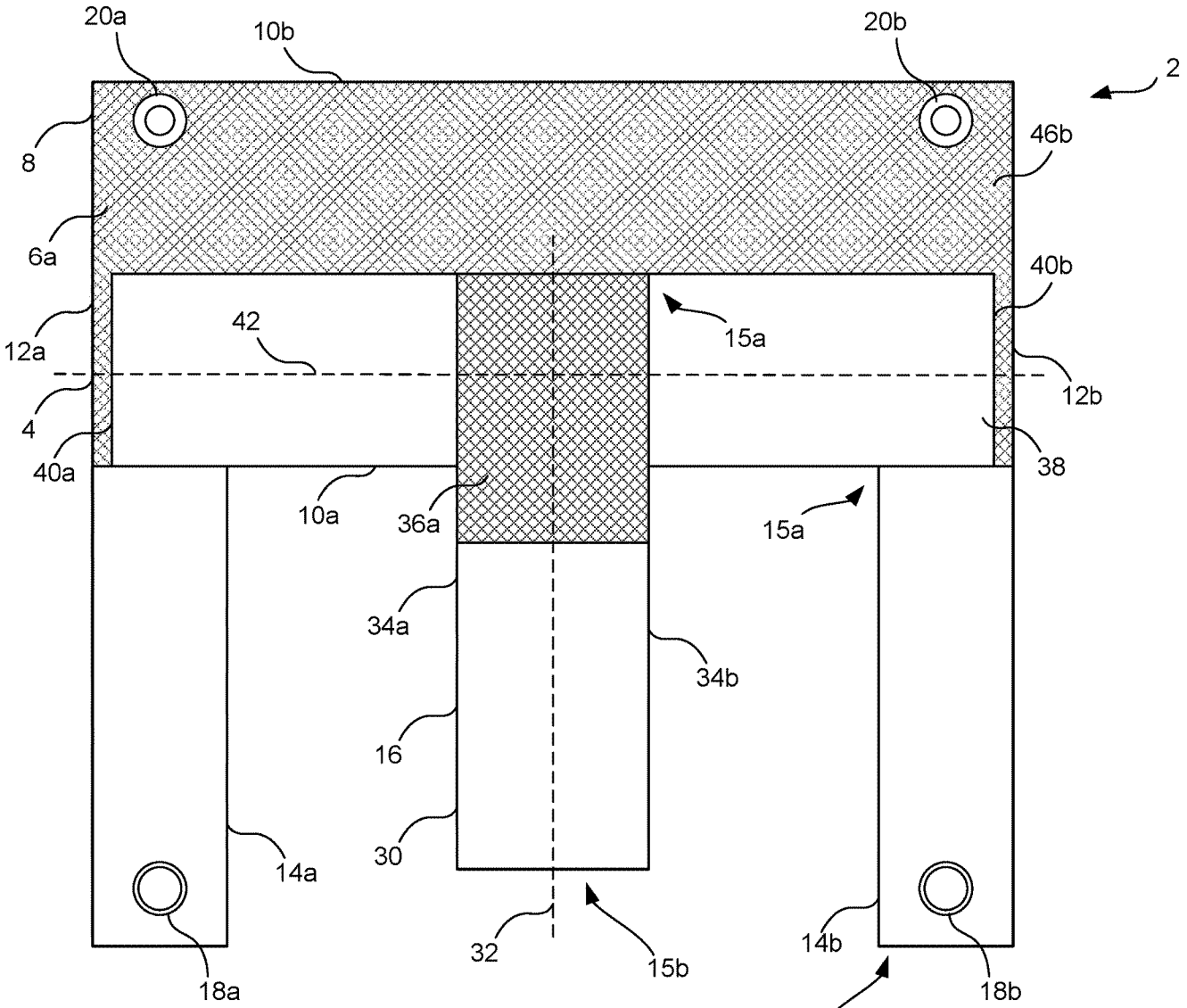
FIG. 1 illustrates a retention system configured to maintain a weapon and/or a holster in a fixed position with respect to an article of clothing, in accordance with some embodiments.
Figure 2:
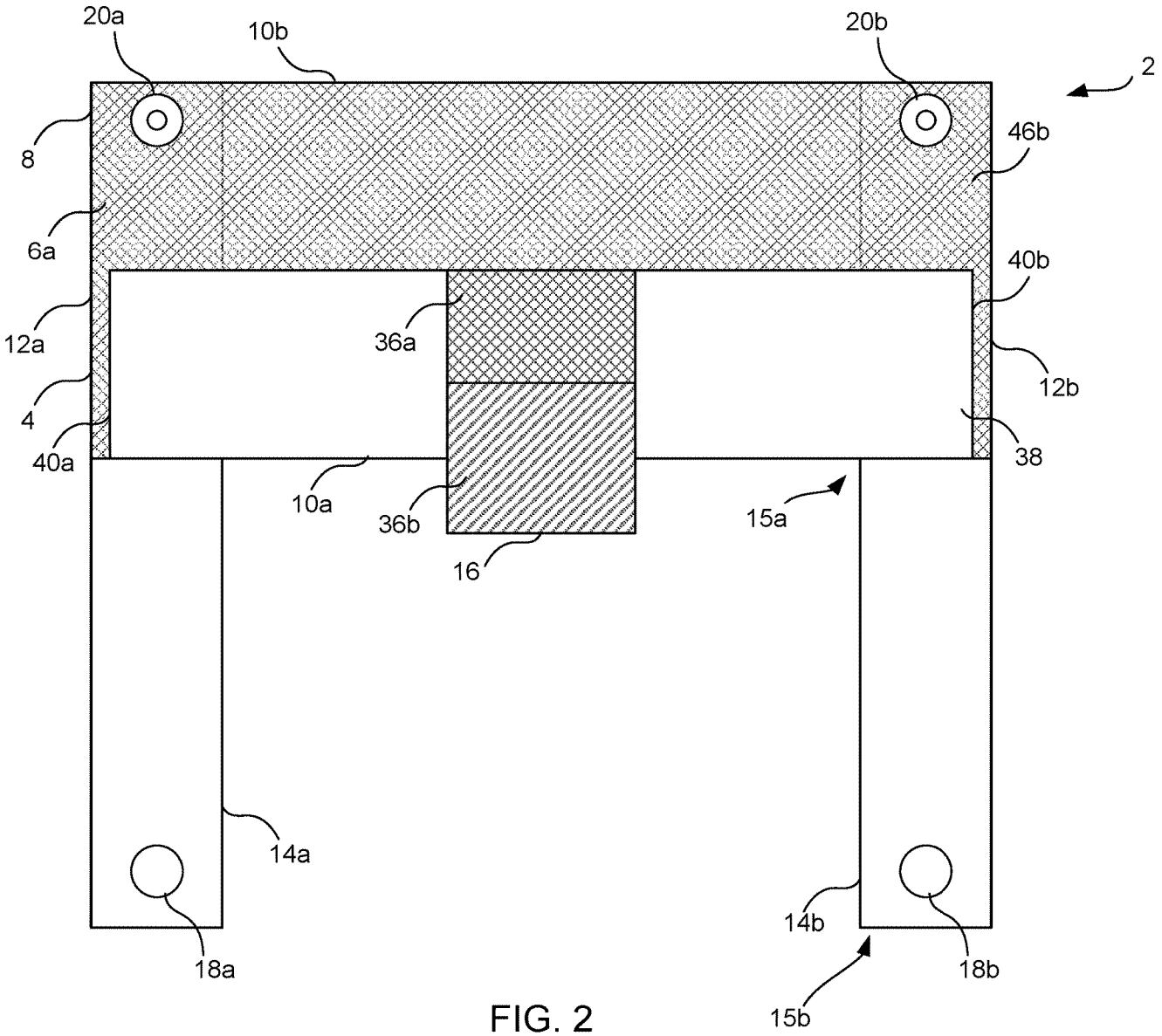
FIG. 2 illustrates the retention system of FIG. 1 having a removable retention element in a retaining position, in accordance with some embodiments.
Figure 3:
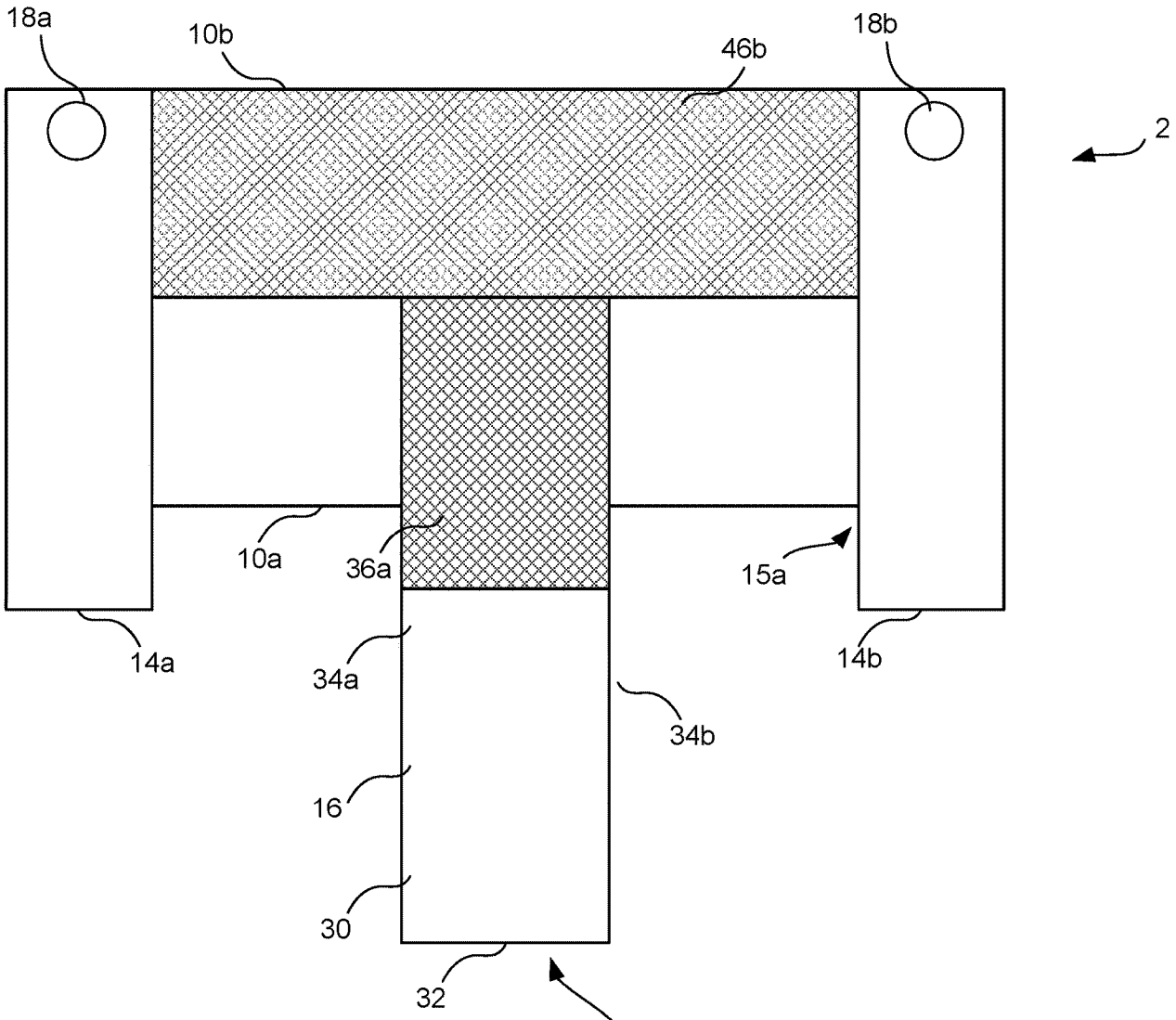
FIG. 3 illustrates the retention system of FIG. 1 having first and second fixed retention elements in a retaining position, in accordance with some embodiments.
Figure 4:
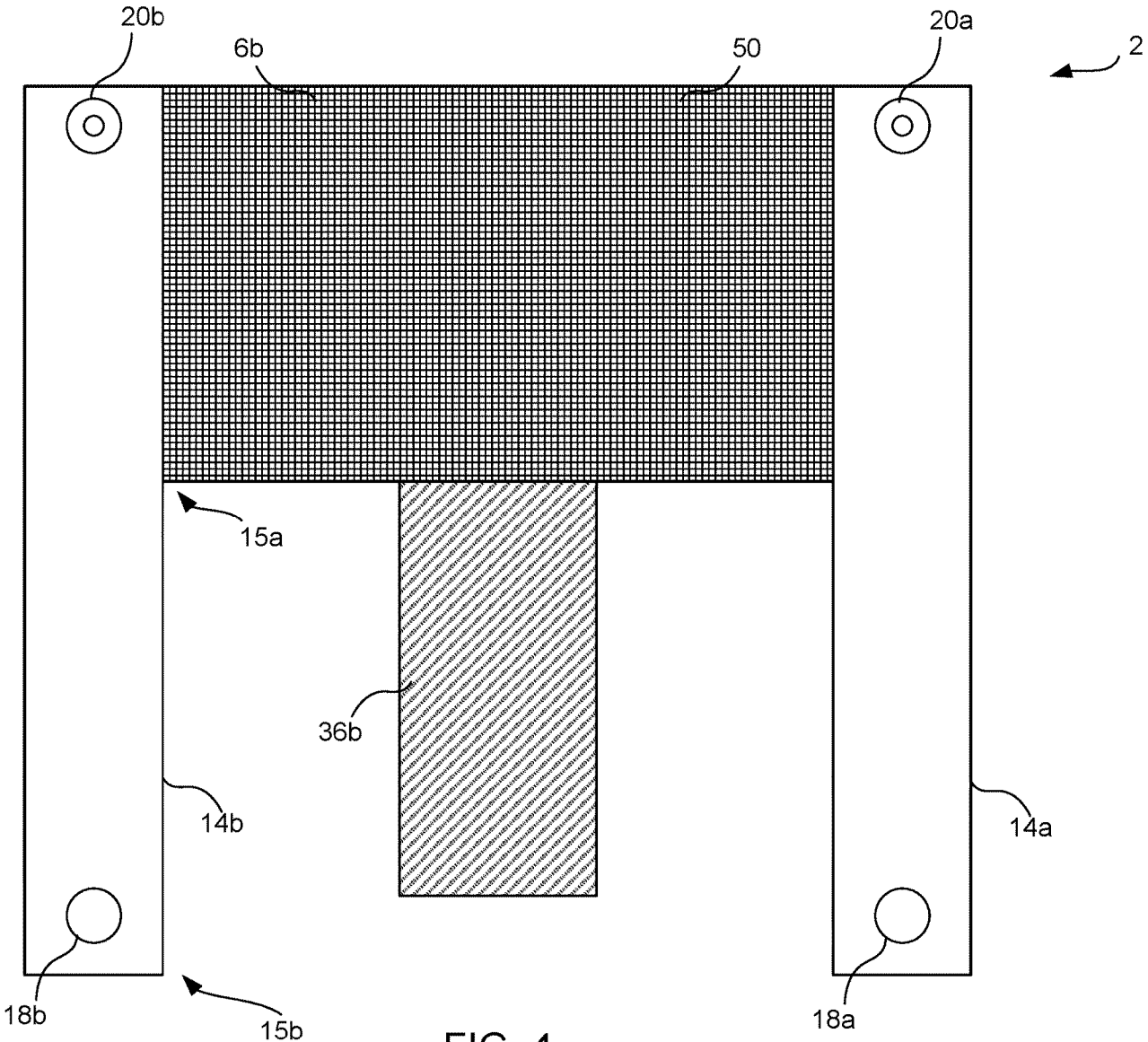
FIG. 4 illustrates a rear view of the retention system of FIG. 1, in accordance with some embodiments.
Figure 5:
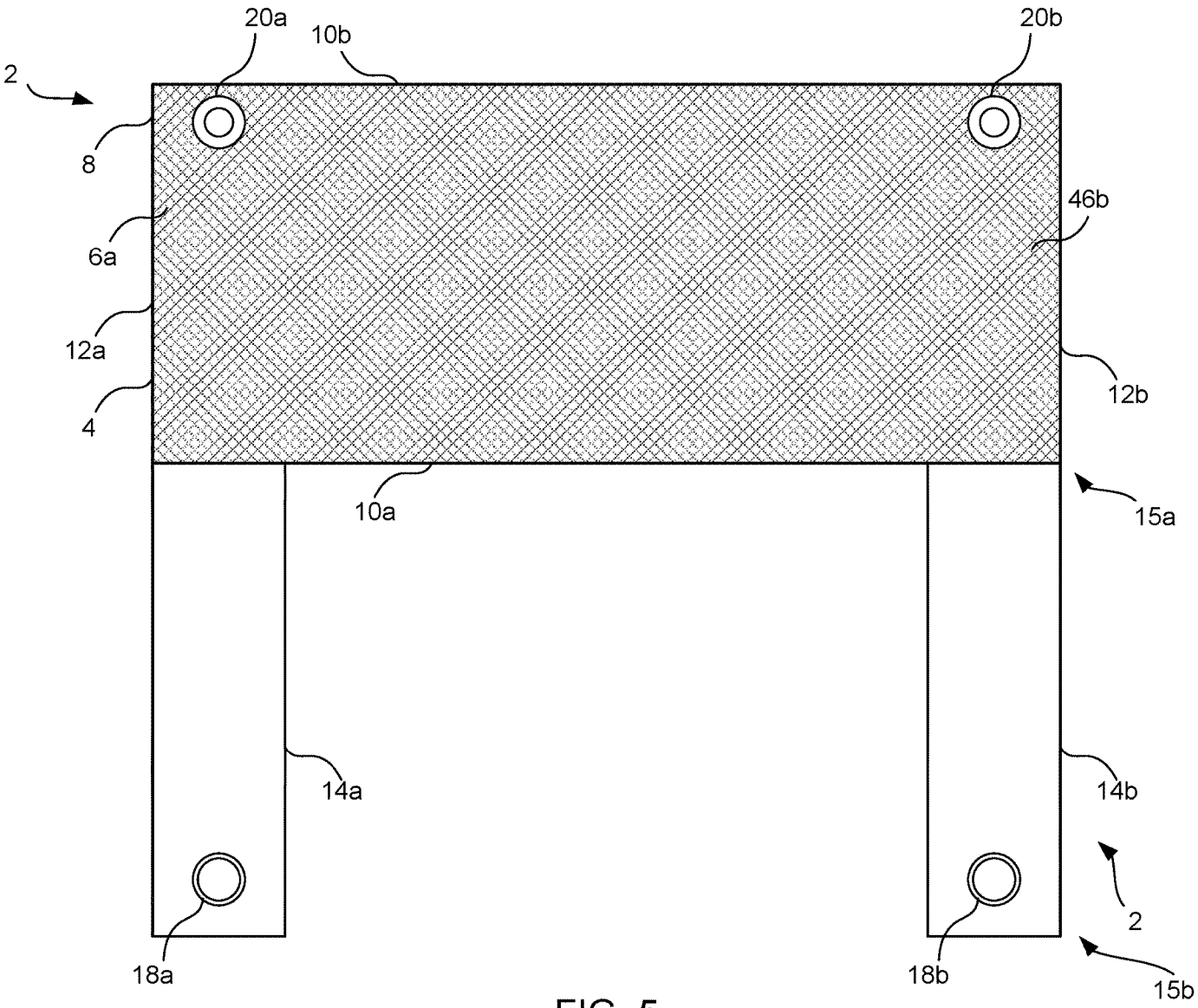
FIG. 5 illustrates a front view of the retention system of FIG. 1 having the removable retention element removed therefrom, in accordance with some embodiments.
Figure 6:
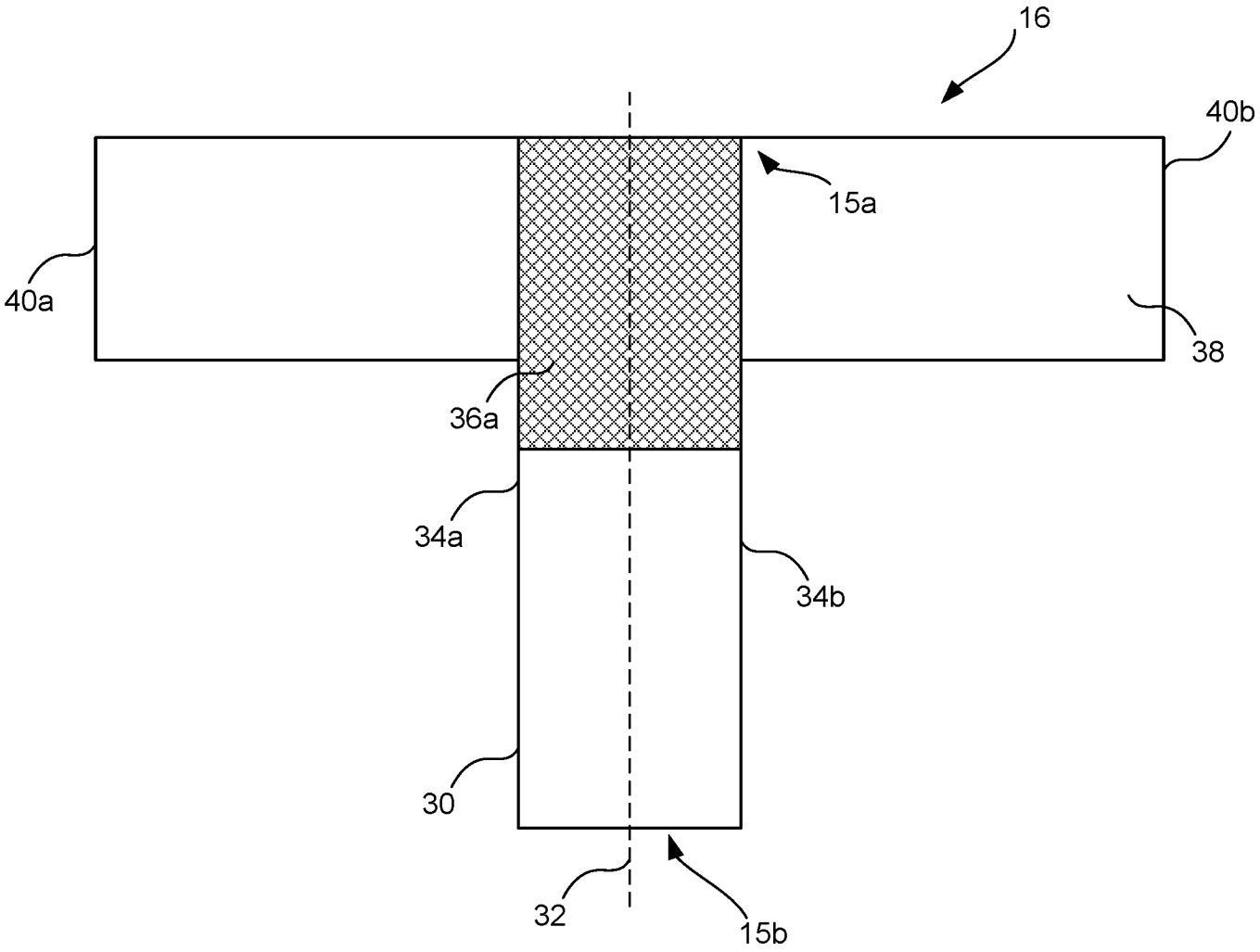
FIG. 6 illustrates a front view of a removable retention element of the retention system of FIG. 1, in accordance with some embodiments.
Figure 7:
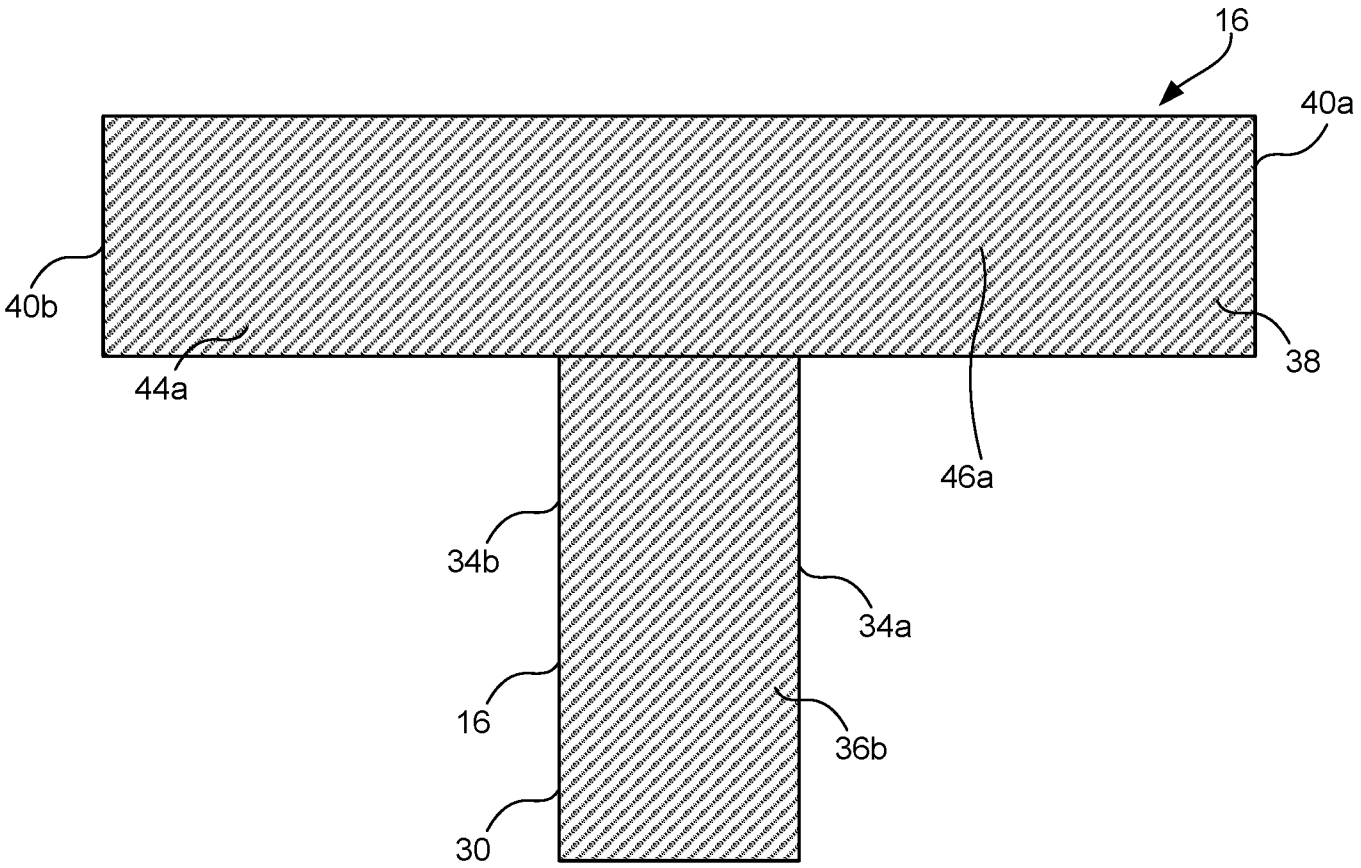
FIG. 7 illustrates a rear view of the removable retention element of FIG. 6, in accordance with some embodiments.

The description of the preferred embodiments is intended to be read in connection with the accompanying drawings, which are to be considered part of the entire written description of this invention. The drawing figures are not necessarily to scale and certain features of the invention may be shown exaggerated in scale or in somewhat schematic form in the interest of clarity and conciseness. In this description, relative terms such as "horizontal," "vertical," "up," "down," "top," "bottom," as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both moveable or rigid attachments or relationships, unless expressly described otherwise. The term "operatively coupled" is such an attachment, coupling, or connection that allows the pertinent structures to operate as intended by virtue of that relationship.

In various embodiments, a retention system for maintaining a weapon and/or a holster for a weapon at a fixed location with respect to an article of clothing is disclosed. The retention system includes a body defined by a perimeter wall and extending between a first side and a second side. A first side of the body defines a garment coupling feature and the second side of the body defines a retention feature. The garment coupling feature includes one or more elements configured to couple the retention system to a garment in a fixed position. The retention feature includes one or more elements configured to couple to and retain a weapon or weapon holster in a fixed position with respect to the body. The retention feature can include a removable retention element, non-removable retention elements, and/or a combination thereof. In some embodiments, the garment coupling feature and/or the retention features are selectively releasable to allow the retention system to be relocated and/or for two or more holsters to be used with a single retention system.

In various embodiments, an article of clothing (or garment) including an integrated retention system is disclosed. The article of clothing can be any suitable article of clothing, such as a shirt, pants, outerwear (e.g., jacket, sweatshirt, hoodie, etc.), underwear, and/or any other suitable article of clothing. A retention system is coupled to the article of clothing, for example, using an attachment mechanism such as threads or glue. In some embodiments, the article of clothing includes a concealment feature configured to conceal the retention system and any weapon and/or holster contained therein. In some embodiments, the concealment feature is a selectively releasable fabric flap.

FIGS. 1-7 illustrate a retention system 2 configured to maintain a weapon and/or a holster in a fixed position with respect to an article of clothing, in accordance with some embodiments. The retention system 2 includes a body 4 including a first surface 6*a* and a second surface 6*b* and defined by a perimeter wall 8. In the illustrated embodiment, the perimeter wall 8 includes a generally rectangular shape defined by a first pair of parallel sides 10*a*, 10*b* and a second pair of parallel sides 12*a*, 12*b*, although it will be appreciated that the body 4 can have any suitable shape. For example, in various embodiments, the body 4 can include any suitable shape such as a regular geometric shape (e.g., square, rectangular, circular, hexagonal, trapezoidal, etc.), non-regular geometric shape, and/or any other suitable shape.

The body 4 includes one or more retention elements 14*a*, 14*b*, 16 formed integrally with and/or coupled thereto. In some embodiments, one or more retention elements 14*a*, 14*b* are fixedly coupled to the body 4. In the illustrated embodiment, the first fixed retention element 14*a* and the second fixed retention element 14*b* extend from an upper surface 10*a* of the body 4. The fixed retention elements 14*a*, 14*b* can be fixedly coupled to the body 4 by any suitable mechanism at a first end 15*a*. For example, in some embodiments, the fixed retention elements 14*a*, 14*b* can coupled to the body 4 using one or more of a thread (i.e., sewn to the body 4) and/or an adhesive (i.e., glued to the body 4), formed integrally with the body 4, and/or otherwise fixedly (or permanently) coupled to the body 4.

In some embodiments, the first and second fixed retention elements 14*a*, 14*b* include flexible straps extending from the upper edge 10*a* of the body 4. The fixed retention elements 14*a*, 14*b* are configured to be folded over a weapon and/or a holster to apply a retention force to the weapon and/or the holster. For example, in the illustrated embodiment, the fixed retention elements 14*a*, 14*b* extend a predetermined distance from the upper edge 10*a* of the body 4 such that the fixed retention elements 14*a*, 14*b* can be folded or looped over an item, such as a weapon or holster, positioned between the body 4 and the fixed retention element 14*a*, 14*b*. In some embodiments, the fixed retention elements 14*a*, 14*b* each include a fixation element 18*a*, 18*b* positioned at a second end 15*b* of the fixed retention element 14*a*, 14*b*. A complimentary fixation element 20*a*, 20*b* is coupled to the body 4 and is configured to retain the fixed retention elements 14*a*, 14*b* in a folded (or retention) position when the fixation element 18*a*, 18*b* is coupled to a respective complimentary fixation element 20*a*, 20*b*.

The fixation element 18*a*, 18*b* and the complimentary fixation element 20*a*, 20*b* can include any suitable fixation elements. For example, in the illustrated embodiment, the fixation element 18*a*, 18*b* includes a snap or button and the complimentary fixation element 20*a*, 20*b* includes a lock configured to releasably couple to the snap (or button). In other embodiments, the fixation elements 18*a*, 18*b* and/or the complimentary fixation elements 20*a*, 20*b* can include any suitable fixation element, such as hook-and-loop fasteners, snap fasteners, stud fasteners, button fasteners, zipper fasteners, and/or any other suitable fastener. In some embodiments, the position of the fixation element 18*a*, 18*b* and the complimentary fixation element 20*a*, 20*b* are fixed on respective retention elements 14*a*, 14*b* and the body 4, although it will be appreciated that, in some embodiments, the fixation elements 18*a*, 18*b* and/or the complimentary fixation elements 20*a*, 20*b* can be releasably coupled such that a respective position of the fixation elements 18*a*, 18*b* on the respective retention element and/or the complimentary fixation elements 20*a*, 20*b* on the body 4 can be adjusted.

In some embodiments, retention system 2 includes a removable fixation element 16 configured to be releasably coupled to the body 4 and to retain a weapon and/or a holster therein. In some embodiments, the removable fixation element 16 includes a flexible strap 30 extending substantially along a longitudinal axis 32 from a first end 30*a* to a second end 30*b* and having thickness extending between a first sidewall 34*a* and a second sidewall 34*b*. In the illustrated embodiment, the flexible strap 30 has a substantially rectangular shape, although it will be appreciated that the flexible strap 30 can include any suitable shape, such as a regular and/or irregular geometric shape.

Figure 8:
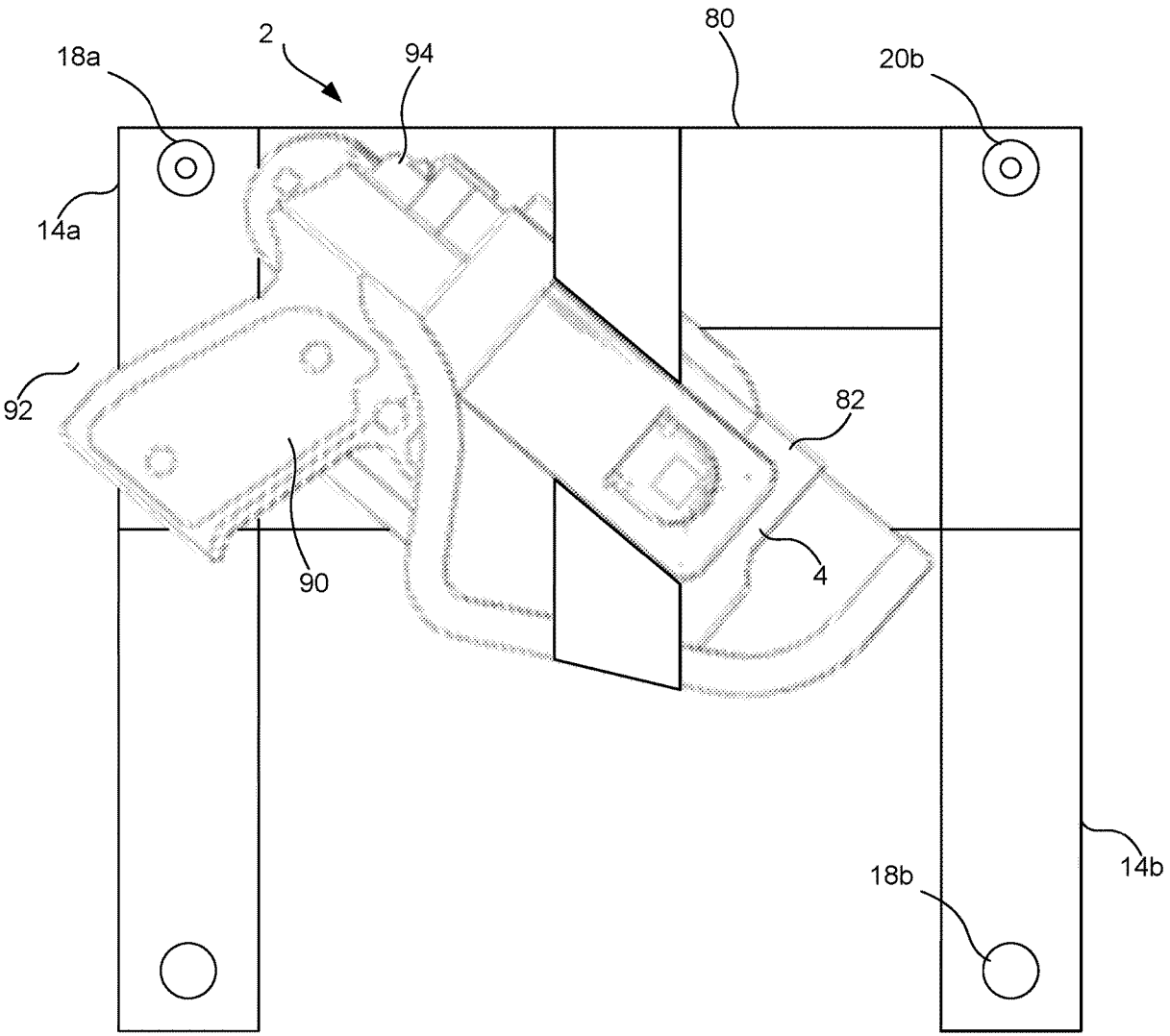
FIG. 8 illustrates the retention system of FIG. 1 having a holster and a firearm retained therein, in accordance with some embodiments.
Figure 9:
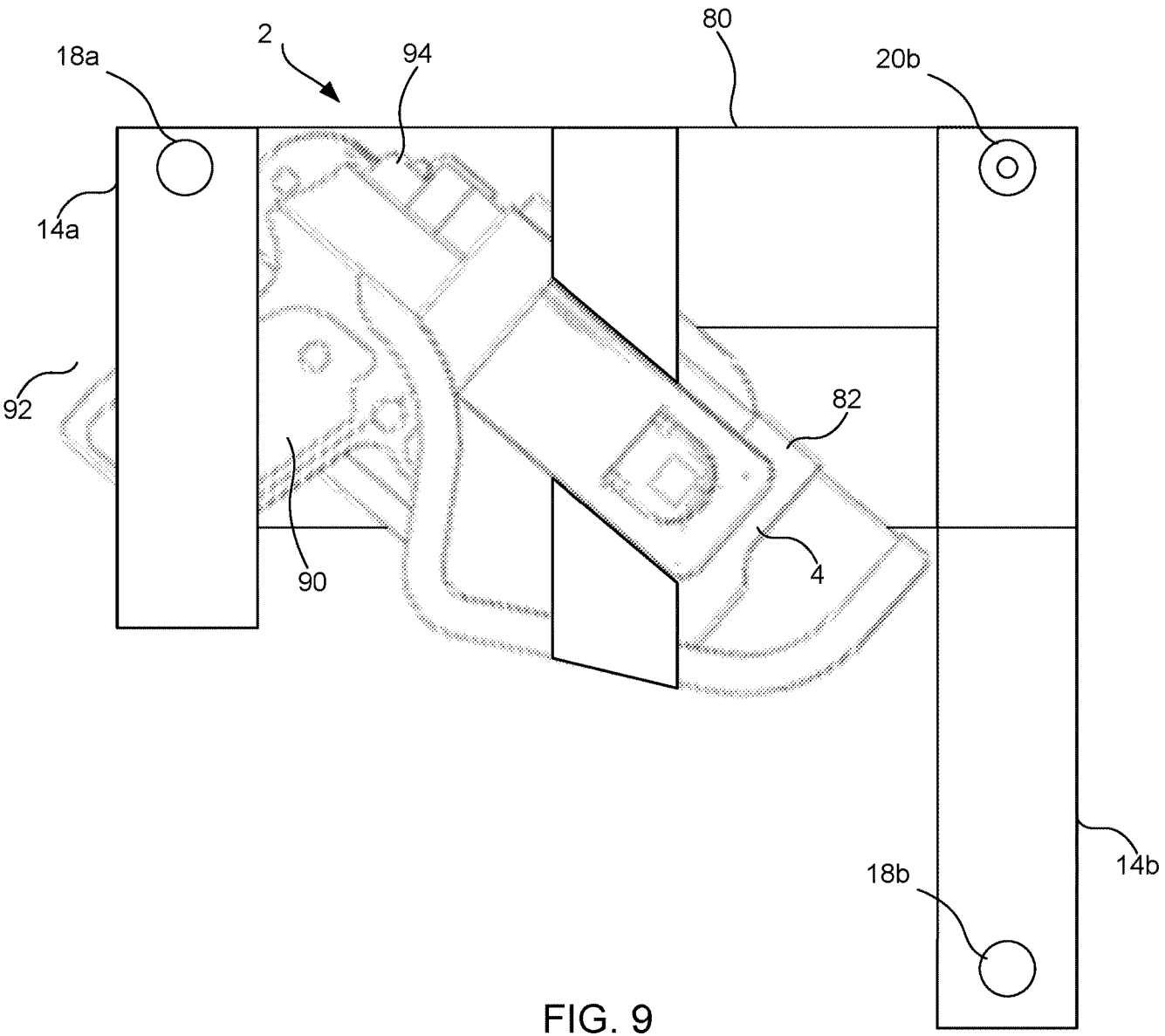
FIG. 9 illustrates the retention system of FIG. 8 including having a fixed retention element in a retaining position with respect to a firearm retained therein, in accordance with some embodiments.
Figure 10:
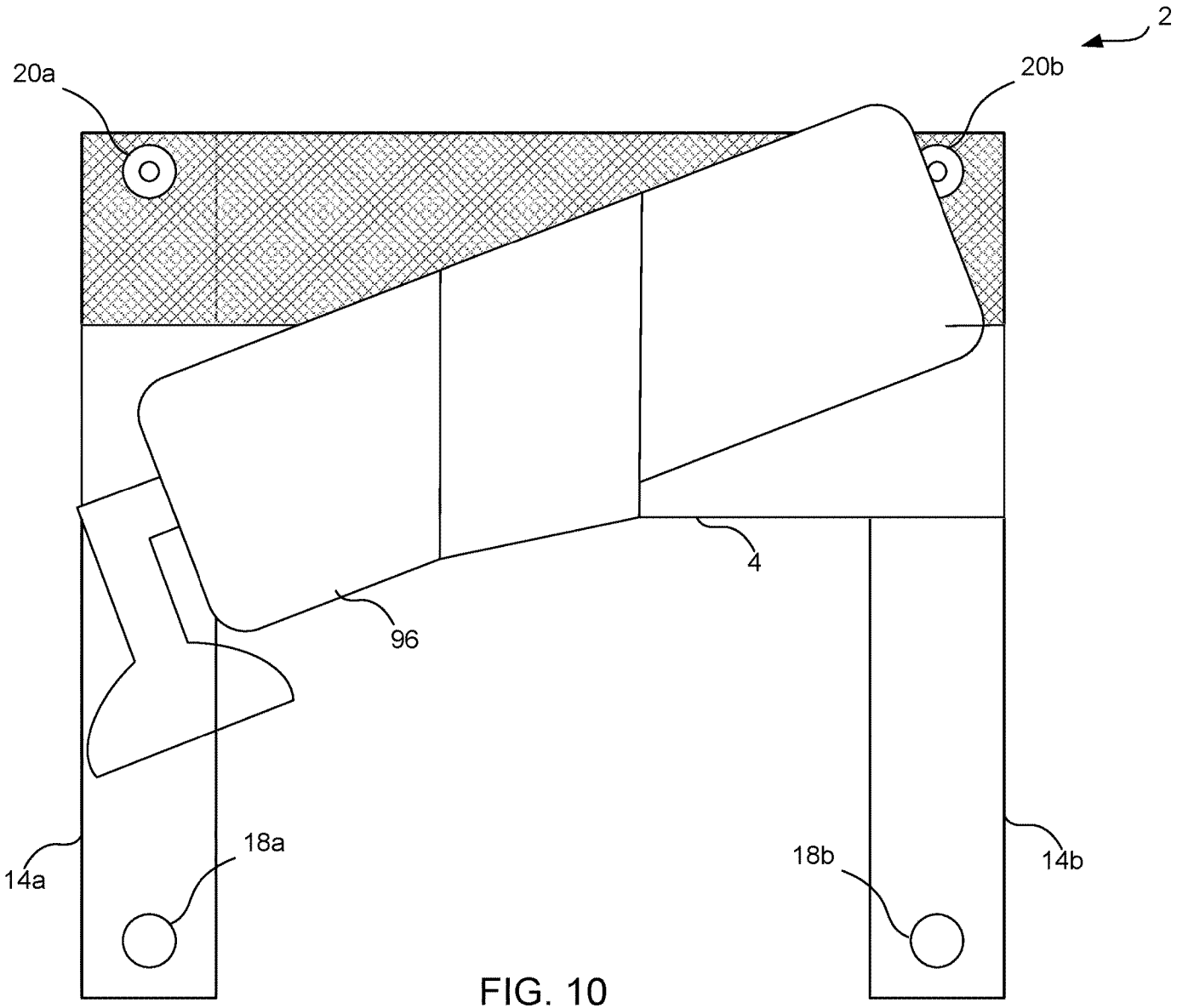
FIG. 10 illustrates the retention system of FIG. 1 having an aerosol self-defense spray retained therein, in accordance with some embodiments.

The flexible strap 30 is configured to be wrapped about and/or otherwise coupled to a holster retention element formed on a weapon holster, as illustrated in FIGS. 8-10. In some embodiments, the flexible strap 30 extends a predetermined length from the first end 30*a* to the second end 30*b* to be wrapped and/or looped around the holster retention element at least once. The flexible strap 30 can be tightened (e.g., wrapped multiple times) and/or shortened to increase a retention force applied by the flexible strap 30 to the holster retention element.

In some embodiments, the flexible strap 30 includes a fixation element configured to maintain the flexible strap 30 in a wrapped (or retention) configuration. For example, in the illustrated embodiment, the first surface 36*a* of the flexible strap 30 defines a plurality of hooks and a second surface 36*b* of the flexible strap 30 defines a plurality of loops that are complimentary to the plurality of hooks to define hook-and-loop fasteners. In some embodiments, the flexible strap 30 can include an alternative and/or additional fixation element, such as, for example, a snap, button, zipper, adhesive, elastic, etc. The flexible strap 30 applies a retention force to the holster retention element to prevent movement of the holster retention element (and therefore the holster) with respect to the flexible strap 30.

In some embodiments, the removable fixation element 16 includes a releasable coupling mechanism configured to releasably couple the removable fixation element 16 to the body 4. For example, in the illustrated embodiment, the releasable coupling mechanism includes a material strip 38 extending from a first end 40*a* to a second end 40*b* generally along a longitudinal axis 42 and including one half of a hook-and-loop fastener 46*a* (with a complimentary portion of the hook-and-loop fastener being disposed on the body 4 as discussed below) disposed on a first surface 44*a* of the material strip 38. In some embodiments, the releasable coupling mechanism includes an alternative and/or additional coupling mechanism, such as one or more snaps, buttons, zippers, adhesives, etc. configured to couple the flexible strap 30 to the body 4.

In some embodiments, the material strip 38 including the releasable coupling mechanism is coupled to the flexible strap 30 such that the longitudinal axis of the material strip 38 is orthogonal to the flexible strap 30, although it will be appreciated that the material strip 38 and the flexible strap 30 can define any suitable angle therebetween. In some embodiments, the material strip 38 is omitted and the releasable coupling mechanism is formed integrally with and/or coupled directly to the flexible strap 30.

In some embodiments, the body 4 includes a complimentary coupling mechanism configured to couple to the releasable coupling mechanism formed integrally with the removable fixation element 16. For example, in the illustrated embodiment, the body 4 includes a complimentary half 46*b* of a hook-and-loop fastener that is complimentary to the releasable coupling mechanism of the removable fixation element 16. In some embodiments, the body 4 can include an additional and/or alternative coupling mechanism configured to couple the removeable fixation element 16 to the body 4, such as, for example, one or more snaps, buttons, zippers, adhesives, etc.

In some embodiments, one or more of the fixed retention elements 14*a*, 14*b* and/or the removable retention element 16 can include an elastic strap or other deformable material. The elastic strap can define a closed shape (such as an elastic loop) or an open shape (such as a longitudinal elastic strap) configured to be deformed (e.g., stretched) around an item, such as a holster and/or weapon coupled to the retention system 2. After being deformed around (e.g., wrapped or stretched around) the holster and/or weapon, the elastic strap attempts to return to its original shape, applying a retention force to the holster and/or weapon. It will be appreciated that any of the retention mechanisms disclosed herein can alternatively and/or additionally include an elastic strap and/or portion configured to apply a retention force.

In some embodiments, the second surface 6*b* of the body 4 is configured to be coupled to a surface, such as an article of clothing, a fabric surface, etc. The second surface 6*b* can include any suitable coupling mechanism, such as, for example, an adhesive 50 disposed over a portion of the second surface 6*b*. The adhesive 50 can include a permanent and/or releasable adhesive. In some embodiments, the second surface 6*b* of the body 4 is sewn to and/or otherwise coupled to the surface using a thread.

As shown in FIG. 8, in some embodiments, a holster 80 (or other weapon container) can be retained by the retention system 2 to maintain a fixed position between the holster 80 and body 4 of the retention system 2. In some embodiments, the holster 80 includes a holster retention mechanism 82, such as a standard clip, C-clip, J-clip, loop, and/or any other holster retention mechanism 82. The holster retention mechanism 82 can be configured to maintain the holster 80 in a semi-fixed position with respect to a user, for example, a retention clip formed on an outside-the-waist-band holster.

In use, the removable retention mechanism 16 can be wrapped around (or otherwise coupled to) the holster retention mechanism 82. For example, in the illustrated embodiment, the flexible strap 30 of the retention mechanism 16 is wrapped around a holster retention mechanism 82 of a holster 80 multiple times to apply a retention force to the holster retention mechanism 82. The removable retention mechanism 16 be coupled to the holster retention mechanism 82 prior to and/or after being coupled to the body 4 of the retention system 2. In some embodiments, the removable retention mechanism 16 is permanently and/or releasably fixed to maintain the retention force on the holster retention mechanism 82. For example, in the illustrated embodiment, the removable retention mechanism 16 includes a hook-and-loop fastener configured to retain the flexible strap 30 in a retention configuration (e.g., wrapped configuration) to maintain the holster 80 in a fixed position with respect to the body 4.

As shown in FIG. 9, in some embodiments, the fixed retention elements 14*a*, 14*b* are configured to provide additional retention to a firearm 90 or other weapon disposed within the holster 80. In some embodiments, the firearm 90 includes a handle 92, slide 94, and/or other portion that extends beyond the holster 80. The handle 92 and/or the slide 94 may extend, for example, beyond the perimeter wall 8 of the body 4. In some embodiments, a fixed retention element 14*a* may be coupled to and/or looped around a portion of the firearm 90 extending beyond the body 4. For example, in the illustrated embodiment, the fixed retention element 14*a* is looped around (e.g., folded over) a portion of the handle 92 and the slide 94 of the firearm 90, although it will be appreciated that additional and/or alternative portions of the firearm 90 can be retained by the fixed retention element 14*a*.

In some embodiments, the fixed retention element 14*a* applies a retention force to the portion of the firearm 90 engaged by the fixed retention element 14*a*. For example, in the illustrated embodiment, the fixed retention element 14*a* applies a retention force to a portion of the handle 92 and the slide 94 engaged by the fixed retention element 14*a*. A second end 15*a* of the fixed retention element 14*a* is coupled to the body 4 by a fixation element 18*a* and a complimentary fixation element 20*a*, as described above. In some embodiments, the force applied by the fixed retention element 14*a* can be increased by looping and/or wrapping the fixed retention element 14*a* around the handle 92 and/or slide 94 of the firearm 90 prior to coupling the fixation element 18*a* to the complimentary fixation element 20*a*.

In some embodiments, the retention system 2 can be configured to retain a non-firearm weapon, such as an aerosol self-defense spray 96, as illustrated in FIG. 10. In some embodiments, the removable retention element 16 can be directly coupled to (e.g., wrapped around) the aerosol self-defense spray 96 prior to and/or after coupling the removable retention element 16 to the body 4. In some embodiments, a portion of the aerosol self-defense spray 96 extends beyond and/or overlaps with a side wall 12*a* of the body 4 such that a portion of the aerosol self-defense spray 96 can be engaged by and/or retained by a fixed retention mechanism 14*a*.

Figure 11:
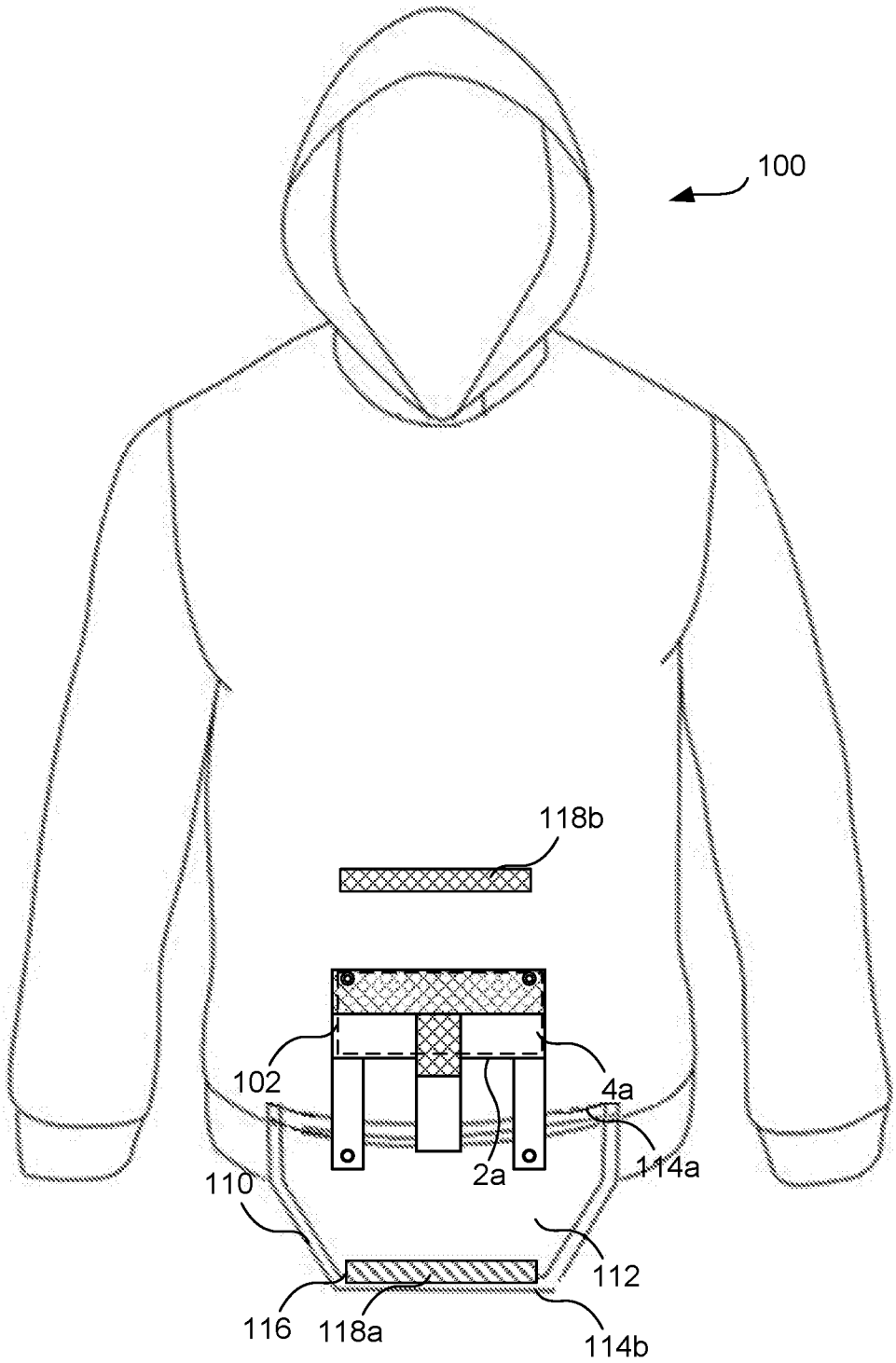
FIG. 11 illustrates an article of clothing including a retention system coupled thereto, in accordance with some embodiments.
Figure 12:
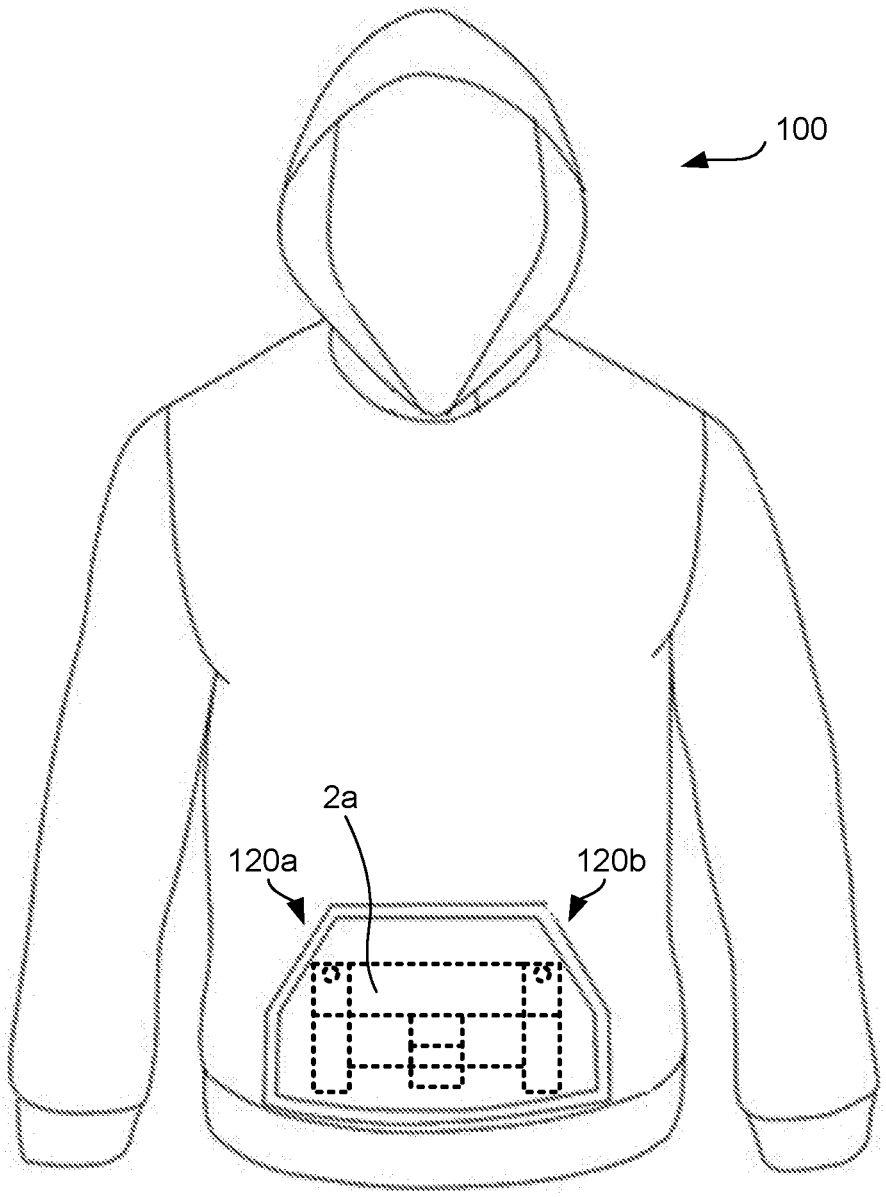
FIG. 12 illustrates the article of clothing of FIG. 11 in a concealed carry configuration, in accordance with some embodiments.

FIGS. 11-12 illustrate an article of clothing 100 including a retention system 2*a* formed integrally therewith, in accordance with some embodiments. In the illustrated embodiment, the article of clothing 100 includes an outer garment, such as a sweatshirt, although it will be appreciated that the article of clothing 100 can include any suitable garment, such as, for example, an outer garment (e.g., sweatshirt, jacket, sweater, pull-over, coat, etc.), a mid-layer garment (e.g., shirt, pants, etc.), or an undergarment. The article of clothing 100 includes a surface area sufficient to couple to the body 4*a* of the retention system 2*a*.

In some embodiments, the retention system 2*a* is releasably and/or permanently coupled to the article of clothing 100. For example, in the illustrated embodiment, the body 4*a* of the retention system 2*a* is permanently coupled to the article of clothing 100 by a thread 102 (i.e., the body 4*a* is sewn to the article of clothing 100), although it will be appreciated that any suitable permanent attachment can be used. For example, in various embodiments, the retention system 2*a* can be coupled to the article of clothing 100 using one or more of a thread; permanent adhesive, and/or other permanent attachment mechanism. In some embodiments, the body 4*a* of the retention system 2*a* is formed integrally with and/or is a portion of the article of clothing 100. For example, in some embodiments, a portion of the surface 104 of the article of clothing 100 functions as the body 4*a* of the retention system 2*a*.

In some embodiments, the retention system 2*a* is releasably coupled to the article of clothing 100. For example, in various embodiments, the body 4*a* of the retention system 2*a* can be releasably coupled to the article of clothing 100 by any combination of zippers, buttons, snaps, clips, pins, removeable adhesives, removable thread, and/or any other suitable releasable coupling mechanism. In some embodiments, the retention system 2*a* can include both a releasable and a permanent attachment mechanism. For example, in some embodiments, the retention system 2*a* can include a releasable adhesive configured to allow the retention system 2*a* to be releasably coupled to the article of clothing 100 for temporary positioning and a thread 102 (or other permanent attachment mechanism) can subsequently be added to permanently attach the retention system 2*a* to the selected location on the article of clothing 100.

In some embodiments, the article of clothing 100 includes a concealment feature 110. The concealment feature 110 is configured to conceal (or hide) the retention system 2*a* and any weapon (or other item) retained therein. For example, in some embodiments, the concealment feature 110 is configured to extend a predetermined distance beyond each edge of the body 4*a* to fully cover the retention system 2*a* and/or any weapon (or other item) retained therein. In the illustrated embodiments, the concealment feature 110 includes a fabric section 112 configured to be placed over the retention system 2*a* to conceal the retention system 2*a* and/or any weapon contained therein, although it will be appreciated that alternative and/or additional concealment features 110 can be used.

In some embodiments, a portion of the concealment feature 110 is permanently coupled to and/or formed integrally with the article of clothing 100. In the illustrated embodiment, a bottom edge 114*a* of the concealment feature 110 is permanently coupled to the article of clothing 100 by a threaded (e.g., sewn) coupling. Although embodiments are illustrated including a threaded connection, it will be appreciated that any suitable coupling mechanism can be used to permanently couple a portion of the concealment feature 110 to the article of clothing 100. For example, in various embodiments, a portion of the concealment feature 110 (such as a bottom edge 114*a*) can be permanently coupled to the article of clothing 100 using one or more of a thread, adhesive, and/or other permanent coupling mechanism.

In some embodiments, the concealment mechanism 110 includes a releasable coupling mechanism 116 configured to releasably couple a portion of the concealment feature 110 to the article of clothing 100. In the illustrated embodiment, the coupling mechanism 116 is disposed along a top edge 114*b* of the concealment feature 110, although it will be appreciated that the coupling mechanism 116 can be disposed on any one or more portions of the concealment feature 110. The releasable coupling mechanism 116 can include any suitable releasable coupling mechanism. In the illustrated embodiment, the releasable coupling mechanism 116 includes one half 118*a* of a hook-and-loop fastener with the other half 118*b* being fixedly coupled to the article of clothing 100. The releasable coupling mechanism 116 may include alternative and/or additional coupling mechanisms, such as a releasable thread, releasable adhesive, buttons, snaps, zippers, etc.

As illustrated in FIGS. 11-12, the concealment feature 110 can be transitioned from a first (or open) position (FIG. 11) to a second (or concealed) position (FIG. 12). A weapon (such as a firearm) or other item (such as a holster) can be coupled to the retention system 2*a* when the concealment feature 110 is in the first position. After coupling the firearm, holster, or other item to the retention system 2*a* (for example as described above), the concealment feature 110 can be transitioned from the first position to the second position to conceal the retention system 2 and the firearm/holster (or other item). In some embodiments, access to the firearm (or other item) is maintained through one or more side openings

120*a*, 120*b* defined between the article of clothing 100 and the concealment feature 110 when the concealment feature 110 is in a second position.

In a self-defense scenario, a wearer of the article of clothing 100 may access the stored firearm (or other item) either through a side opening 120*a*, 120*b* and/or by releasing the concealment feature 110 from the article of clothing 100. For example, in some embodiments, a firearm (or other item) can be accessed by a user through a side opening 120*a*. The user may grip the firearm (or other item) and withdraw the firearm through the side opening 120*a*. Alternatively and/or additionally, the user may use a second hand to release the concealment feature 110 from the article of clothing 100, exposing the retention system 2*a* and allowing easier removal of a firearm from a holster retained by the retention system 2*a*.

Figure 13:
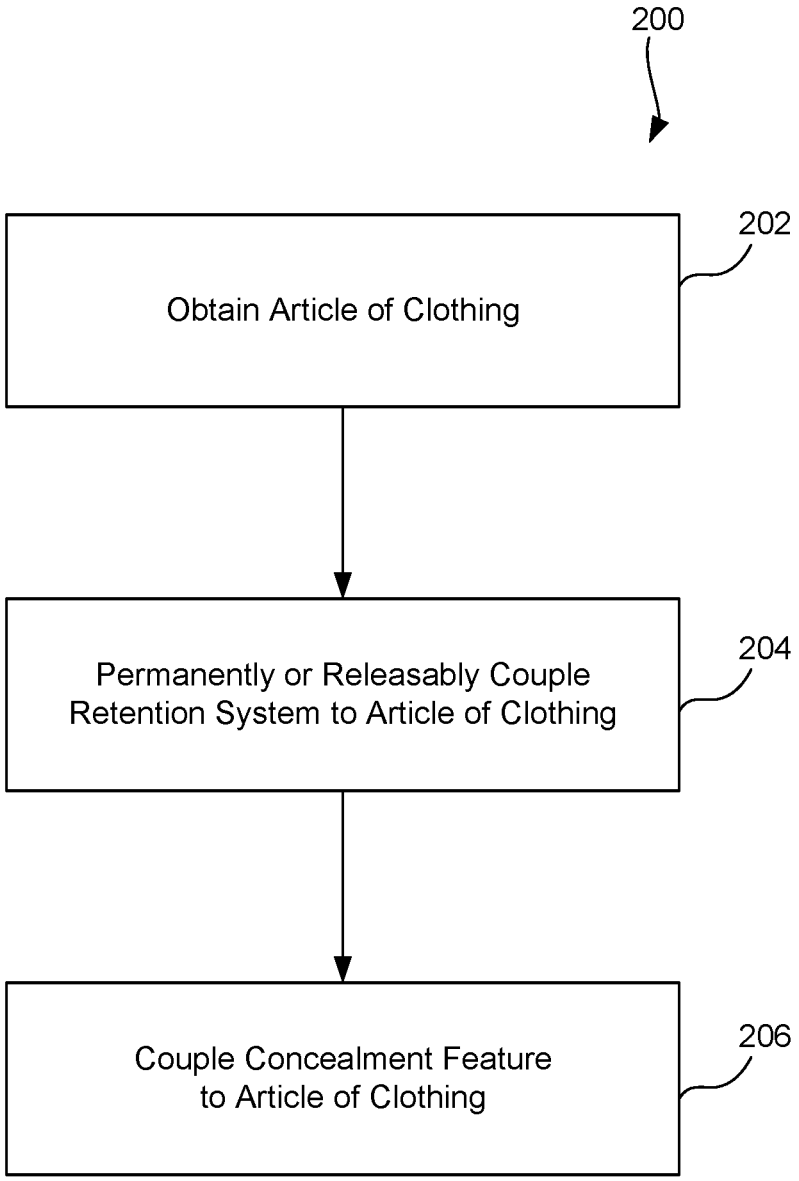
FIG. 13 illustrates a method of forming an article of clothing with an integrated retention system, in accordance with some embodiments.

FIG. 13 illustrates a method 200 of forming an article of clothing 100 with an integrated retention system, in accordance with some embodiments. At step 202, an article of clothing, such as an outer garment, mid-layer garment, and/or undergarment, is manufactured and/or obtained. The article of clothing 100 may be produced in conjunction with and/or separate from a retention system 2*a*. For example, in some embodiments, the article of clothing 100 is an "off-the-shelf" garment, such as a garment purchased at a retail location. As another example, in some embodiments, the article of clothing 100 is a custom-made garment designed to be coupled to a retention system 2*a*.

At step 204, a retention system 2*a* is permanently and/or releaseable coupled to the article of clothing 100. In some embodiments, the retention system 2*a* is permanently coupled to the article of clothing by one or more permanent attachment mechanisms, such as, for example, thread, permanent adhesive, and/or any other suitable attachment mechanism. In some embodiments, prior to, alternatively, and/or in addition to being permanently attached, the retention system 2*a* is releasably coupled to the article of clothing 100 by one or more releasable attachment mechanisms, such as, for example, removable thread, removeable adhesive, hook-and-loop, buttons, snaps, and/or any other suitable temporary attachment mechanism.

At step 206, a concealment feature 110 is coupled to the article of clothing 100. The concealment feature 110 can include any suitable concealment feature, such as, for example, a fabric strip or cloth. The concealment feature 110 can be permanently and/or releasably coupled to the article of the clothing 100. For example, in some embodiments, a bottom edge of the concealment feature 110 is permanently coupled to the article of clothing 100 by one or more permanent attachment elements, such as, for example, thread, permanent adhesive, and/or any other suitable attachment mechanism. In some embodiments, an upper edge of the concealment feature 110 is releasably coupled to the article of clothing 100 by one or more releasable attachment elements, such as, for example, hook-and-loop fasteners, releasable adhesive, removable thread, buttons, snaps, etc. Although step 206 is illustrated after step 204, it will be appreciated that step 206 can be performed prior to and/or simultaneously with step 204.

Figure 14:
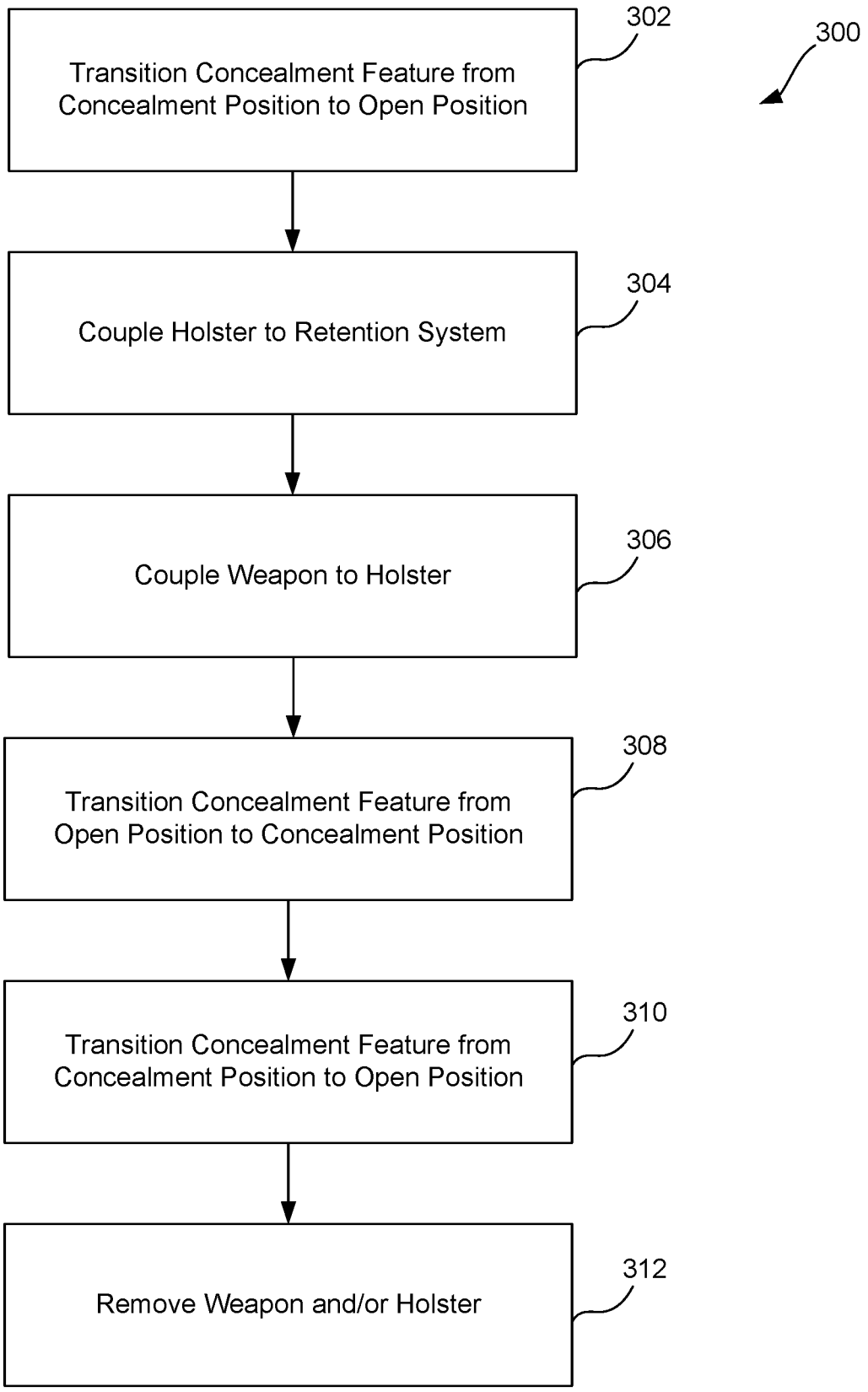
FIG. 14 illustrates a method of using an article of clothing including an integrated retention system, in accordance with some embodiments.

FIG. 14 illustrates a method 300 of using an article of clothing 100 including an integrated retention system 2*a*, in accordance with some embodiments. At step 302, a concealment feature 110 coupled to the article of clothing 100 is transitioned from a concealment position to an open position to expose a retention system 2*a* coupled to and/or formed integrally with the article of clothing 100. Step 302 may be omitted in embodiments in which the concealment feature 110 begins in an open position.

At step 304, a holster is coupled to the retention system 2*a* by a releasable retention element 16. For example, in some embodiments, the releasable retention element 16 is removed from the body 4*a* and is wrapped around a holster retention mechanism 82 of a holster 80 to maintain the holster 80 in a fixed position with respect to the releasable retention element 16. After coupling to the holster retention mechanism 82, the releasable retention element 16 can be coupled to the body 4*a* to maintain the holster 80 in a fixed position with respect to the body 4*a* and the article of clothing 100. At step 306, a weapon or other item can be coupled to the holster 80. For example, in various embodiments, a firearm 90 can be inserted into and retained by the holster 80. Although step 306 is illustrated subsequent to step 304, it will be appreciated that steps 304 and 306 can be performed in any order and/or can be combined into a single step in some embodiments.

At step 308, the concealment feature 110 is transitioned from the open position to a concealed position. In the concealed position, the retention system 2*a*, the holster 80, and the firearm 90 are hidden between the article of clothing 100 and the concealment feature 110 such that no portion of the retention system 2*a*, holster 80, or firearm 90 is visible. The article of clothing 100 can be worn by a user without providing a visual indication that the user is carrying a self-defense weapon.

At step 310, the concealment feature 110 can again be transitioned from the concealed position to the open position to expose the retention system 2*a*, the holster 80, and the firearm 90. The firearm 90 can be removed from the holster 80, which is retained by the releasable retention element 16 in a fixed position with respect to the article of clothing 100. The firearm 90 may be used for self-defense, target, and/or other purposes and/or may be unloaded/stored. In some embodiments, the firearm 90 maybe returned to the holster 80 and maintained in a fixed position with respect to the article of clothing 100.

At step 312, the holster 80 can be removed from the retention system 2*a*. For example, in some embodiments, the releasable retention element 16 is released from the body 4*a*. The releasable retention element 16 can be disconnected from and/or unwound from the holster retention mechanism 82 to release the holster 80 from the releasable retention element 16. After removing the holster 80, the releasable retention element 16 may be recoupled to the body 4*a* for storage.

Figure 15:
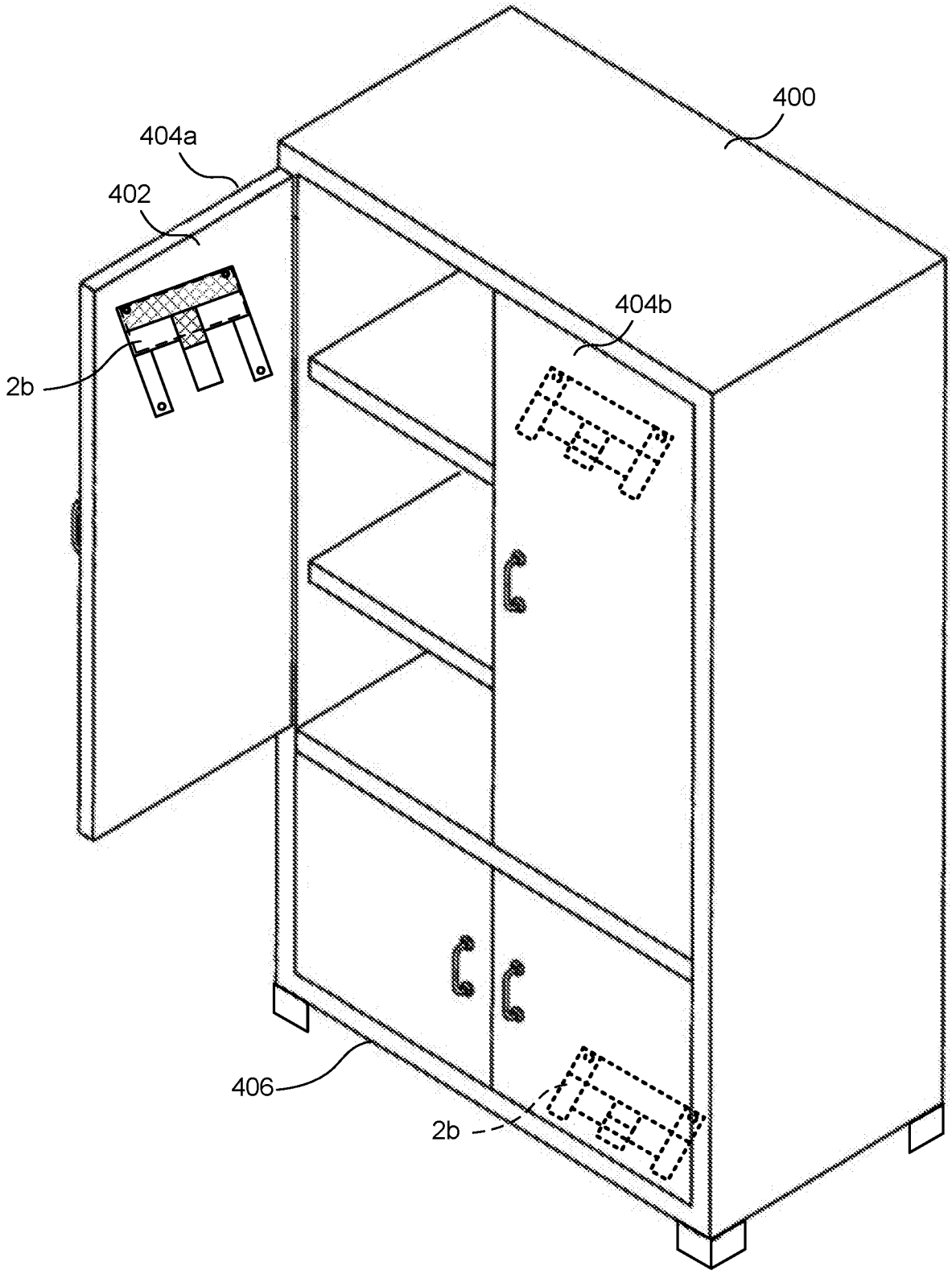
FIG. 15 illustrates a retention system coupled to a surface of an item of furniture, in accordance with some embodiments.
Figure 16:
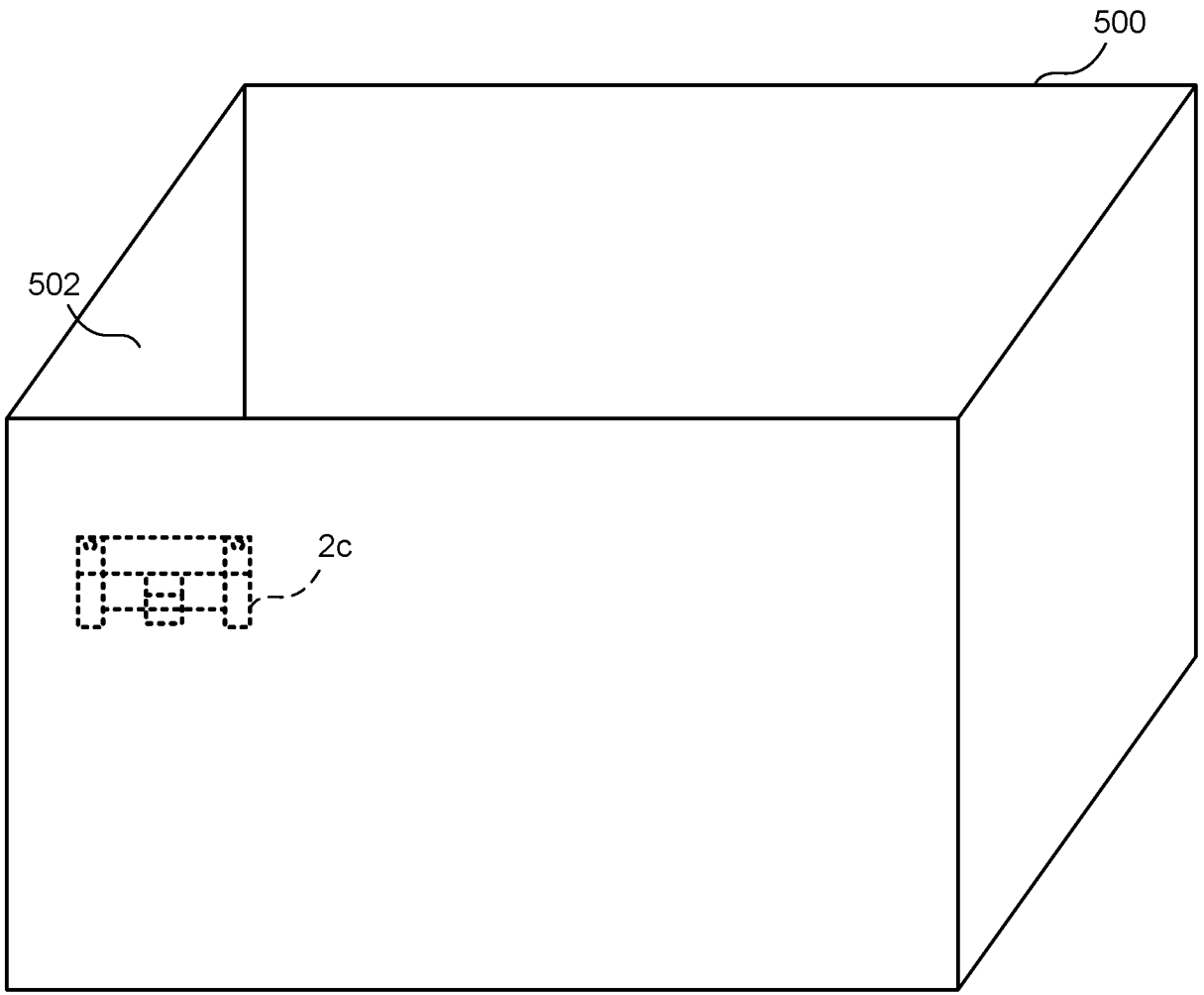
FIG. 16 illustrates a retention system coupled to an inner surface of a container, in accordance with some embodiments.

It will be appreciated that a retention system, such as retention system 2 discussed above, can be coupled to any suitable surface using a permanent and/or releasable attachment mechanism, such as a hook-and-loop fastener, an adhesive, screws/nails, etc. FIG. 15 illustrates one embodiment of a retention system 2*b* coupled to a surface of an item of furniture 400 and FIG. 16 illustrates one embodiment of a retention system 2*c* coupled to an inner surface 502 of a container 500. Although example embodiments are illustrated, it will be appreciated that a permanent and/or releasable attachment mechanism can be configured to couple a retention system, such as retention systems 2*b*, 2*c*, to any suitable surface including, but not limited to, a surface in a home (e.g., furniture surface, wall, door, ceiling, cabinet interior/exterior, etc.), office (e.g., furniture surface wall, door, ceiling, cabinet interior/exterior, desk interior/exterior, etc.), vehicle (e.g., vehicle surface, vehicle seat, vehicle container (e.g., motorcycle saddlebag/container), glove box, etc.), and/or any other suitable location.

It will be appreciated that the retention system 2 is configured to allow concealment of a firearm 90 and/or other defensive item on one or more surfaces, such as a surface in a home, office, vehicle, etc. For example, as shown in FIG. 15, a retention system 2*b* can be attached to any suitable surface of an item of furniture 400, such as an interior surface 402 of cabinet door 404*a*, interior surface of a cabinet door 404*b*, a bottom surface 406 of the item of furniture 400, and/or any other suitable surface. Similarly, as shown in FIG. 16, the retention system 2*c* can be coupled to an inner surface 502 of a container 500, such as a container contained within and/or attached to a vehicle (e.g., cooler, saddlebag, luggage, etc.). The retention system 2 allows a firearm 90 or other defensive item to be coupled to and/or concealed by any surface having a suitable surface area for attachment of the retention system 2. Other examples include, but are not limited to, a surface of an interior door having a facing relationship with an interior wall (such that the surface of the door is concealed by the wall when the door is in an open position), beneath one or more surfaces (e.g., attached to a bottom surface of a cabinet, desk, chair, etc.), and/or any other suitable position.

Although the subject matter has been described in terms of exemplary embodiments, it is not limited thereto. Rather, the appended claims should be construed broadly, to include other variants and embodiments, which may be made by those skilled in the art.

What is claimed is:

1. A retention system, comprising:

a body comprising a first surface and a second surface and defined by a perimeter wall;

a first retention element releasably coupled to the body, wherein the first retention element is configured to be coupled to a weapon system to maintain the weapon system in a fixed position with respect to the body;

a second retention element coupled to and extending from the perimeter wall at a first end of the body, wherein the second retention element is configured to engage a first end of the weapon system, and wherein a portion of the second retention element overlaps a first portion of the first retention element in a retention position, wherein the second retention element is fixedly coupled to the body, wherein the second retention element comprises a releasable coupling mechanism and the body comprises a complimentary coupling mechanism, and wherein the second retention element is transitioned to the retention position by coupling the releasable coupling mechanism to the complimentary coupling mechanism, wherein the releasable coupling mechanism comprises a first side of a snap fastener and the complimentary coupling mechanism comprises a second side of a snap fastener; and a third retention element coupled to and extending from the perimeter wall at a second end of the body, wherein the third retention element is configured to engage a second end of the weapon system, wherein a portion of the third retention element overlaps a second portion of the first retention element in a retention position, and wherein the second portion of the first retention element is parallel to and spaced apart from the first portion of the first retention element.

2. The retention system of claim 1, wherein the first retention element is releasably coupled to the body by a first side of a hook-and-loop fastener, and wherein a second side of the hook-and-loop fastener is fixedly coupled to the body.

3. The retention system of claim 1, wherein the first retention element comprises a flexible strap extending from the perimeter wall of the body.

4. The retention system of claim 3, wherein the first retention element is configured to be coupled to the weapon system by wrapping the flexible strap about a coupling element of the weapon system.

5. The retention system of claim 4, wherein a first portion of the first retention element comprises a first side of a hook-and-loop fastener and a second portion of the first retention element comprises a second side of the hook-and-loop fastener.

6. The retention system of claim 1, wherein the second surface of the body comprises an attachment mechanism configured to couple the body to a concealable surface.

7. The retention system of claim 6, wherein the concealable surface is selected from the group consisting of: a surface of an article of clothing, a surface of an item of furniture, a surface of a vehicle, a surface of a container, and a surface of a structure.

8. A system, comprising:

an article of clothing; and a retention system coupled to the article of clothing, the retention system comprising:

a body comprising a first surface and a second surface and defined by a perimeter wall, wherein the second surface is coupled to the article of clothing;

a first retention element releasably coupled to the body, wherein the first retention element is configured to be coupled to a weapon system to maintain the weapon system in a fixed position with respect to the body;

a second retention element coupled to and extending from the perimeter wall at a first end of the body, wherein the second retention element is configured to engage a first end the weapon system, and wherein a portion of the second retention element overlaps a first portion of the first retention element in a retention position, wherein the second retention element is fixedly coupled to the body, wherein the second retention element comprises a releasable coupling mechanism and the body comprises a complimentary coupling mechanism, and wherein the second retention element is transitioned to the retention position by coupling the releasable coupling mechanism to the complimentary coupling mechanism, wherein the releasable coupling mechanism comprises a first side of a snap fastener and the complimentary coupling mechanism comprises a second side of a snap fastener; and a third retention element coupled to and extending from the perimeter wall at a second end of the body, wherein the third retention element is configured to engage a second end of the weapon system, wherein a portion of the third retention element overlaps a second portion of the first retention element in a retention position, and wherein the second portion of the first retention element is parallel to and spaced apart from the first portion of the first retention element.

9. The system of claim 8, wherein the article of clothing comprises a concealment feature configured to be transitioned from a first position in which the retention system is visible to a second position in which the retention system is concealed by the concealment feature.

10. The system of claim 9, wherein the concealment feature comprises a fabric strip at least partially permanently coupled to the article of clothing.

11. The system of claim 10, wherein the concealment feature comprises a first coupling element and the article of clothing comprises a second coupling element, and wherein the first coupling element and the second coupling element are configured to releasably couple a portion of the concealment feature to the article of clothing.

12. The retention system of claim 8, wherein the first retention element is releasably coupled to the body a first side of a hook-and-loop fastener, and wherein a second side of the hook-and-loop fastener is fixedly coupled to the body.

13. The retention system of claim 8, wherein the first retention element comprises a flexible strap extending from the perimeter wall of the body, the flexible strap comprising a first coupling element on a first side and a complimentary second coupling element on a second side.

14. A method, comprising:

transitioning a concealment feature of an article of clothing from a first position to a second position to expose a retention system coupled to the article of clothing;

coupling a weapon system to the retention system, wherein the retention system comprises a body including a first surface and a second surface and defined by a perimeter wall and a first retention element releasably coupled to the body, a second retention element coupled to and extending from the perimeter wall at a first end of the body, wherein the second retention element is fixedly coupled to the body, wherein the second retention element comprises a releasable coupling mechanism and the body comprises a complimentary coupling mechanism, and wherein the second retention element is transitioned to the retention position by coupling the releasable coupling mechanism to the complimentary coupling mechanism, wherein the releasable coupling mechanism comprises a first side of a snap fastener and the complimentary coupling mechanism comprises a second side of a snap fastener, and a third retention element coupled to and extending from the perimeter wall at a second end of the body, wherein the second retention element is configured to engage a first end the weapon system, wherein a portion of the second retention element overlaps a first portion of the first retention element in a retention position, wherein the third retention element is configured to engage a second end of the weapon system, wherein a portion of the third retention element overlaps a second portion of the first retention element in a retention position, wherein the second portion of the first retention element is parallel to and spaced apart from the first portion of the first retention element, wherein the second surface is coupled to the article of clothing, and wherein the first retention element is configured to be coupled to the weapon system to maintain the weapon system in a fixed position with respect to the body; and transitioning the concealment feature from the second position to the first position to conceal the retention system and the weapons system.

* * * * *